US011384744B2

(12) United States Patent
Zhang et al.

(10) Patent No.: US 11,384,744 B2
(45) Date of Patent: Jul. 12, 2022

(54) PERISTALTIC PUMP PRECISE DOSING CONTROL SYSTEM AND CONTROL METHOD THEREOF

(71) Applicant: Baoding Lead Fluid Technology Co., Ltd., Hebei (CN)

(72) Inventors: Xiaoling Zhang, Hebei (CN); Jichao Yuan, Hebei (CN); Tao Shi, Hebei (CN); Yanfeng Zhang, Hebei (CN)

(73) Assignee: Baoding Lead Fluid Technology Co., Ltd., Baoding (CN)

( * ) Notice: Subject to any disclaimer, the term of this patent is extended or adjusted under 35 U.S.C. 154(b) by 0 days.

(21) Appl. No.: 17/142,200

(22) Filed: Jan. 5, 2021

(65) Prior Publication Data

US 2021/0363978 A1 Nov. 25, 2021

(30) Foreign Application Priority Data

May 25, 2020 (CN) ..... 202010450497.2

(51) Int. Cl.

| | |
|---|---|
| ***F04B 13/00*** | (2006.01) |
| ***F04B 17/03*** | (2006.01) |
| ***F04B 43/12*** | (2006.01) |
| ***F04B 49/00*** | (2006.01) |

(52) U.S. Cl.

CPC ..... *F04B 13/00* (2013.01); *F04B 17/03* (2013.01); *F04B 43/1261* (2013.01); *F04B 49/00* (2013.01)

(58) Field of Classification Search

CPC ..... F04B 13/00; F04B 17/03; F04B 43/1261; F04B 49/00

See application file for complete search history.

(56) References Cited

U.S. PATENT DOCUMENTS

2015/0159642 A1* 6/2015 Sasa ..... F04B 43/1253 417/279
2019/0136853 A1* 5/2019 Bach ..... F04B 49/22

* cited by examiner

*Primary Examiner* — Patrick Hamo
(74) *Attorney, Agent, or Firm* — Novick, Kim & Lee, PLLC; Allen Xue

(57) ABSTRACT

A peristaltic pump precise dosing control system includes a driver, a pump head, pipeline switching means, a metering pipeline, and a discharge pipeline. An elastic tubing is provided in the pump head, and the outlet end of the elastic tubing is connected to the pipeline switching means. The driver drives the pump head to rotate to pump the liquid in the elastic tubing to the outlet end of the elastic tubing. The driver is electrically connected to the pipeline switching means so as to be capable of controlling the pipeline switching means to switch to the output pipeline with which the outlet end of the elastic tubing is connected. The pipeline switching means is driven to switch the outlet end of the elastic tubing from a state of connection with the discharge pipeline to a state of connection with the metering pipeline.

8 Claims, 6 Drawing Sheets

PERISTALTIC PUMP PRECISE DOSING CONTROL SYSTEM AND CONTROL METHOD THEREOF

FIELD

Embodiments of the present disclosure relate to the field of peristaltic pumps, and more particularly relate to a peristaltic pump precise dosing control system and a control method thereof.

BACKGROUND

A typical peristaltic pump comprises a driver (not shown), a pump head 101, and an elastic tubing 102, as shown in FIG. 1. When the peristaltic pump operates, fluid 103 is fully filled in the elastic tubing 102; the driver drives, via a shaft 108, a roller wheel 104 in the pump head 101 to rotate; during rotating of the roller wheel, a plurality of rollers 105 on the circumference of the roller wheel 104 alternately and sequentially squeeze the elastic tubing 102 towards a compression block 106 and then release it, thereby forming a negative pressure in the elastic tubing 102 to pump the liquid 103. Compared with other pump types, the peristaltic pump features good controllability, contamination free, cleanness, and precise transfer. It is currently extensively applied in various fields such as biology, environment protection, chemical engineering, pharmacy, laboratory, and smart manufacturing, which thus has a huge market prospect.

Dosed liquid filling is one of main applications of peristaltic pumps. For conventional peristaltic pump dosed dispensing functions, a substantially identical dispensed liquid volume is achieved by controlling the motor to rotate the same number of laps.

However, due to occurrence of pulsation during operating of the peristaltic pump, a tubing squeezing part (dependent on different features, the tubing squeezing part is generally referred to as a roller wheel or rotor in the peristaltic pump field) would abruptly release the squeezed volume when leaving the working surface at the outlet end, causing abrupt decrease of the liquid flow at the outlet end. Moreover, the larger the tubing inner diameter is, the more volume on the tubing is squeezed by the tubing squeezing part, and the more apparently the flow pulsation occurs at the outlet end. Due to position variation of the tubing squeezed point at each task-oriented actuation of the peristaltic pump and occurrence of pulsation, a deviation of one dose volume squeezed by the tubing squeezing part on the tubing exists between the liquid volumes transferred within the same time interval. Therefore, a larger tubing inner diameter causes a greater error in liquid volume dispensing.

To guarantee the precision of scale dispensing of the peristaltic pump, a conventional practice is to select a tubing with a smaller inner diameter. However, this approach has a problem that to transfer the same liquid volume, the tubing with a smaller inner diameter requires more rotating laps, which not only prolongs filling time and deteriorates efficiency, but also increases the squeezed frequency of the tubing, significantly shortening its service life and lowering its stability in dosed transfer.

Linear peristaltic pump products currently available in the market may solve the above problem. By turning the rotational motion into a stroke-adjustable single-stroke repetitive linear motion, the linear peristaltic pump realizes precise dosing in liquid volume dispensing. However, the linear peristaltic pump has a complex structure and a high cost; besides, it cannot operate continuously, and has a long return stroke time and a poor universality.

SUMMARY

To solve the technical problem of a relatively large dosing error incurred by position variation of the tubing squeezed point at each task-oriented actuation of the peristaltic pump and occurrence of pulsation, embodiments of the present disclosure provide a peristaltic pump precise dosing control system and a control method thereof.

In one aspect of the present disclosure, there is provided a peristaltic pump precise dosing control system, comprising: a driver, a pump head, pipeline switching means, a metering pipeline, and a discharge pipeline.

An elastic tubing is provided in the pump head, and the outlet end of the elastic tubing is connected to the pipeline switching means;

The pipeline switching means is adaptable to switch the outlet end of the elastic tubing to be connected to the metering pipeline or the discharge pipeline;

The driver drives the pump head to rotate to pump the liquid in the elastic tubing to the outlet end of the elastic tubing; and the driver is electrically connected to the pipeline switching means so as to be capable of controlling the pipeline switching means to switch to the output pipeline to which the outlet end of the elastic tubing is connected;

in response to a position detection signal that the driver has driven the pump head to rotate to a predetermined start position, the pipeline switching means switches the outlet end of the elastic tubing from a state of connection with the discharge pipeline to a state of connection with the metering pipeline.

Furthermore, the peristaltic pump precise dosing control system further comprises an input line that is connected to the inlet end of the elastic tubing in the pump head.

Furthermore, the discharge pipeline is connected to the input line so as to form a backflow passage from the outlet end of the elastic tubing to the input line.

Furthermore, the driver drives the pump head to rotate to the predetermined start position in response to a dosing-output start signal or a dosing-output end signal, and then drives the pipeline switching means to switch the outlet end of the elastic tubing from a state of connection with the discharge pipeline to a state of connection with the metering pipeline.

Furthermore, the peristaltic pump precise dosing control system further comprises position detecting means configurable to detect whether the pump head has rotated to the predetermined start position, the driver being electrically connected to the position detecting means so as to obtain a position detection signal indicating whether the pump head has rotated to the predetermined start position.

Furthermore, the driver comprises a control panel and an electric motor, the control panel being connected to an electric motor, the position detecting means, and the pipeline switching means, respectively;

The position detecting means is provided on the electric motor, or the pump head, or a connector between the electric motor and the pump head.

Furthermore, the roller wheel of the pump head has at least one roller, and the position detecting means is adaptable to detect any of the at least one roller regarding whether it has revolved to the predetermined start position.

The position detecting means comprises a magnetic inductor and a magnetic steel, wherein the magnetic inductor, which is electrically connected to the driver and disposed at a rear shaft that drives the pump head to rotate, is adaptable to detect rotation of the magnetic steel.

In another aspect of the present disclosure, there is provided a control method of the peristaltic pump precise dosing control system, comprising steps of:

obtaining, by the driver, a position detection signal to determine whether the pump head has rotated to a predetermined start position;

in response to a position detection signal that the pump head has not rotated to the predetermined start position, controlling, by the driver, the pipeline switching means such that the outlet end of the elastic tubing is connected to a discharge pipeline, wherein the driver controls the pump head to continue rotating toward the predetermined start position.

in response to a position detection signal that the pump head is at the predetermined start position, controlling, by the driver, the pipeline switching means such that the outlet end of the elastic tubing is connected to a metering pipeline, and then the driver is capable of controlling and driving the pump head to rotate to output dosed liquid.

In a further aspect of the present disclosure, there is provided a peristaltic pump precise dosing control system, which, when performing dosing output of fluid, comprises steps of:

obtaining a position detection signal to determine whether the pump head has rotated to a predetermined start position;

in response to the position detection signal that the pump head has not rotated to the predetermined start position, connecting the outlet end of the elastic tubing to a discharge pipeline, and controlling the pump head to continue rotating toward the predetermined start position;

in response to the position detection signal that the pump head is at the predetermined start position, connecting the outlet end of the peristaltic pump elastic tubing to a metering pipeline, so as to be capable of controlling and driving the pump head to rotate to output dosed liquid.

Furthermore, in response to a dosing-output start signal or a dosing-output end signal, obtaining a position detection signal to determine whether the pump head has rotated to the predetermined start position.

Furthermore, the liquid discharged via the discharge pipeline returns to the input of the peristaltic pump.

The peristaltic pump precise dosing control system and the control method thereof as provided in the embodiments of the present disclosure achieve a precise dosing transfer while maintaining original advantages of the peristaltic pump such as cleanness, maintenance friendliness, and good controllability; the present disclosure has advantages including simple structure, high dosing precision, continuous operability, efficient transfer, low cost and wide applicability (to various pump heads). The peristaltic pump precise dosing control system is further provided with pipeline switching means and a discharge pipeline over conventional peristaltic pumps, wherein by determining the rotated position of the pump head and actuating the pipeline switching means at appropriate time to switch to a connected pipeline, it is realized that liquid is discharged during adjustment of the pump head; furthermore, the present disclosure realizes a complete identical pump head start position for each dosing output of liquid, thereby eliminating dosing transfer errors incurred by pulsation and offering a high repetitive precision.

DETAILED DESCRIPTION OF EMBODIMENTS

To make the objects, technical solutions, and advantages of the present disclosure much clearer, the present disclosure will be further described in detail with reference to the accompanying drawings and preferred embodiments. However, those skilled in the art should understand that the present disclosure is not limited to the drawings and the embodiments.

Figure 1:
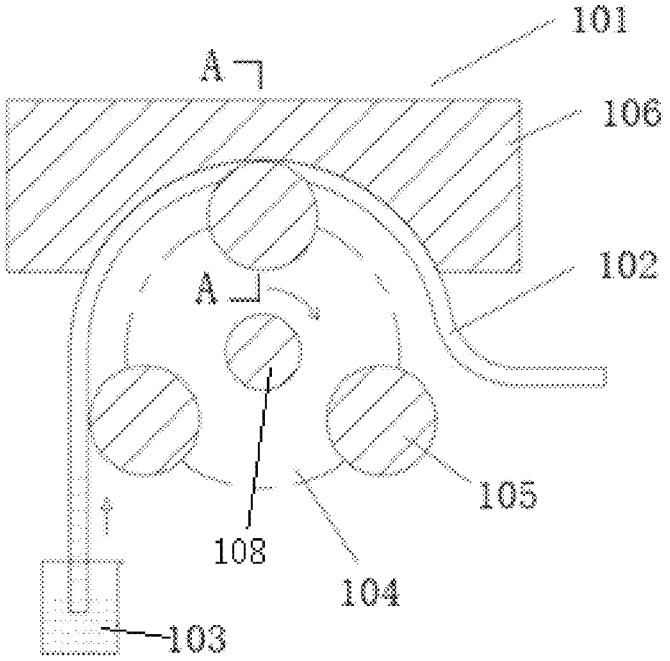
FIG. 1 is a structural schematic diagram of a conventional peristaltic pump.
Figure 2:
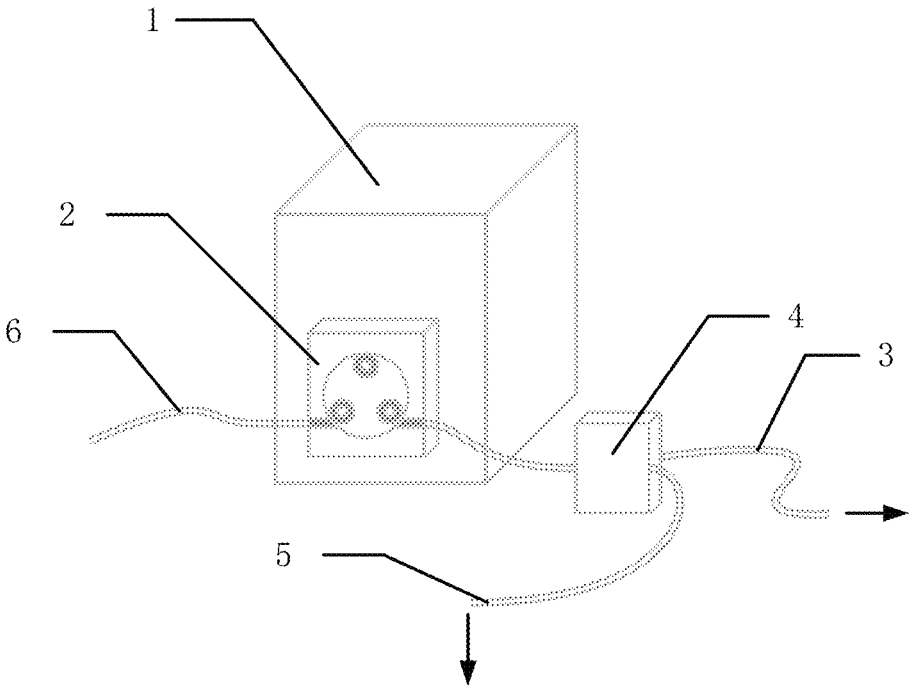
FIG. 2 is a structural schematic diagram of a peristaltic pump precise dosing control system according to an embodiment of the present disclosure.

Embodiments of the present disclosure provide a peristaltic pump precise dosing control system. As shown in FIG. 1, the peristaltic pump precise dosing control system comprises a driver 1, an input line 6, a pump head 2, pipeline switching means 4, a metering pipeline 3, and a discharge pipeline 5.

An elastic tubing (not shown) is provided in the pump head 2, wherein the inlet end of the elastic tubing in the pump head 2 is connected to the input line 6, and the outlet end of the elastic tubing is connected to the pipeline switching means 4. Those skilled in the art would appreciate that the input line 6 may also serve as the elastic tubing in the pump head 2; alternatively, the input line 6 and the elastic tubing refer to different lines, but mutually connected; the outlet end of the elastic tubing may also be connected to the pipeline switching means 4 via a separate connecting tube.

The pipeline switching means 4 is adaptable to switch the outlet end of the elastic tubing to be connected to the metering pipeline 3 or the discharge pipeline 5. The pipeline switching means 4 may be, for example, a rotary valve, an isolation valve, a switch valve, a solenoid valve, and a diaphragm valve.

The driver 1 drives the pump head 2 to rotate such that a tubing squeezing part in the pump head 2 rotates to sequentially and alternately squeeze and release the elastic tubing in the pump head 2, which forms a negative pressure in the elastic tubing to pump the liquid from the input line 6 to the outlet end. The driver 1 is electrically connected to the pipeline switching means 4; the driver 1 controls the pipeline switching means 4 to switch to the output pipeline connected to the outlet end of the elastic tubing, such that the outlet end of the elastic tubing is connected to the metering pipeline 3 or the discharge pipeline 5.

The driver 1 drives the pump head 2 to rotate to a predetermined start position, and then drives the pipeline switching means 4 to switch the outlet end of the elastic tubing from a state of connection with the discharge pipeline 5 to a state of connection with the metering pipeline 3. In an alternative embodiment, the driver 1 drives the pump head 2 to rotate to the predetermined start position in response to a dosing-output start signal or a dosing-output end signal, and then drives the pipeline switching means 4 to switch the outlet end of the elastic tubing from a state of connection with the discharge pipeline 5 to a state of connection with the metering pipeline 3. Those skilled in the art would appreciate that at any time between one dosing output and the next dosing output, the driver 1 drives the pump head 2 to rotate to the predetermined start position and then drives the pipeline switching means 4 to switch the outlet end of the elastic tubing from a state of connection with the discharge pipeline 5 to a state of connection with the metering pipeline 3.

In an embodiment, the peristaltic pump precise dosing control system further comprises position detecting means configurable to detect whether the pump head 2 has rotated to the predetermined start position. The position detecting means may be provided on the electric motor, the pump head or a connector between the electric motor and the pump head; the driver 1 is electrically connected to the position detection means to obtain a position detection signal indicating whether the pump head 2 has rotated to the predetermined start position. In an embodiment, at least one roller (referring to FIG. 1) is provided on the roller wheel of the pump head 2, and the position detection means detects any of the rollers regarding whether it has revolved to the predetermined start position.

In an embodiment of the present disclosure, the position detecting means comprises a magnetic inductor and a magnetic steel, wherein the magnetic inductor is provided in the rear portion of the electric motor and electrically connected to the driver 1; the magnetic steel is provided at a rear shaft of the electric motor; and the magnetic inductor is adaptable to detect rotation of the magnetic steel. In this way, during the rotating process of a rotary tubing squeezing part, the magnetic steel on the electric motor will rotate along therewith, and the electric signal of the magnetic inductor will vary; whether the pump head 2 has rotated to the predetermined start position may be determined based on the comparison with an electric signal threshold of a magnetic induction chip at the predetermined start position.

In another embodiment of the present disclosure, the position detecting means comprises a Hall sensor; the Hall sensor is provided on a stationary tubing squeezing part (e.g., the tubing compression block in FIG. 1) of the pump head 2 and electrically connected to the driver 1; the magnetic steel is provided near the edge of the rotary hose squeezing part (e.g., the roller wheel in FIG. 1) of the pump head 2, e.g., provided on at least one of the rollers. Of course, in cases where the roller is made of a steel material, the magnetic steel becomes unnecessary. In this way, during the rotating process of the rotary tubing squeezing part, the magnetic steel/steel roller thereon would approach back and forth to the Hall sensor distant from the stationary tubing squeezing part, and the electric signal of the Hall sensor will vary; whether the pump head 2 has rotated to the predetermined start position may be determined based on the comparison with an electric signal threshold of the Hall sensor at the predetermined start position.

In addition, the position detecting means may also be optoelectronic detection means, a proximity switch, and a reed switch, etc.

Figure 3:
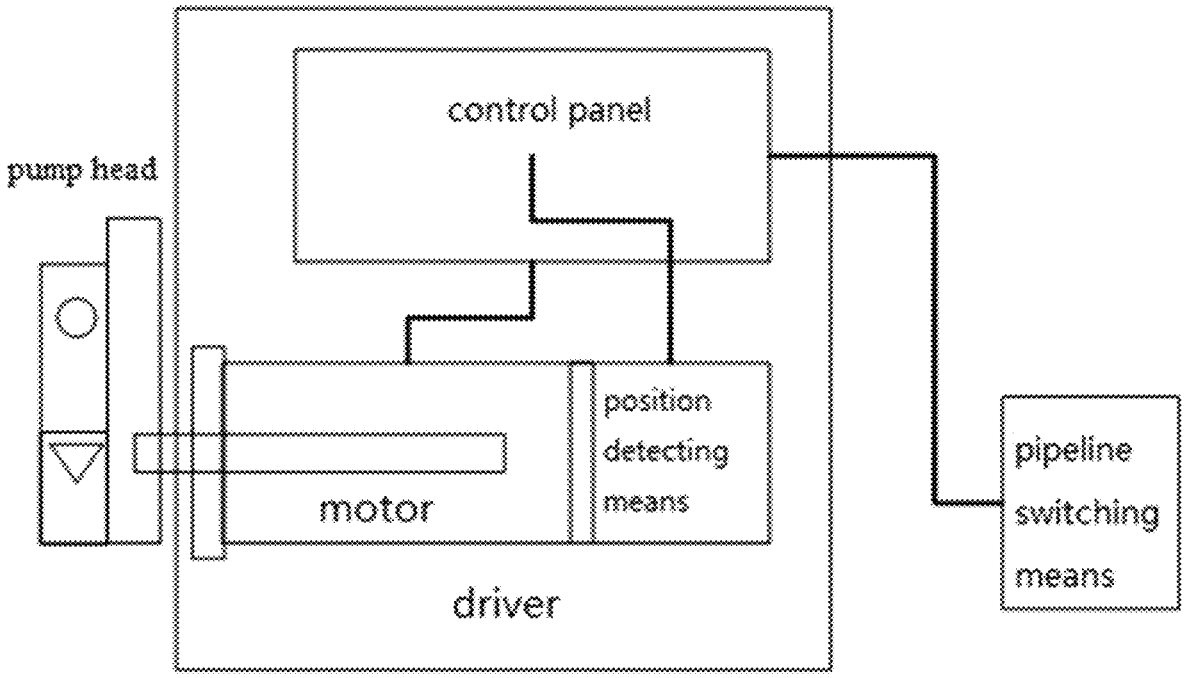
FIG. 3 is a schematic diagram of circuit connection of the peristaltic pump precise dosing control system according to an embodiment of the present disclosure.

FIG. 3 is a schematic diagram of circuit connection of the peristaltic pump precise dosing control system according to an embodiment of the present disclosure. The driver 1 comprises a control panel, an electric motor, and position detecting means, wherein the position detecting means is provided on the electric motor and configured for detecting a rotated position of the electric motor shaft. The control panel is connected to the electric motor, the position detecting means, and the pipeline switching means 4, respectively. The control panel controls the electric motor to start to drive the pump head to output dosed liquid; the control panel controls the pipeline switching means 4 to perform line switching as per instructions.

Figure 4:
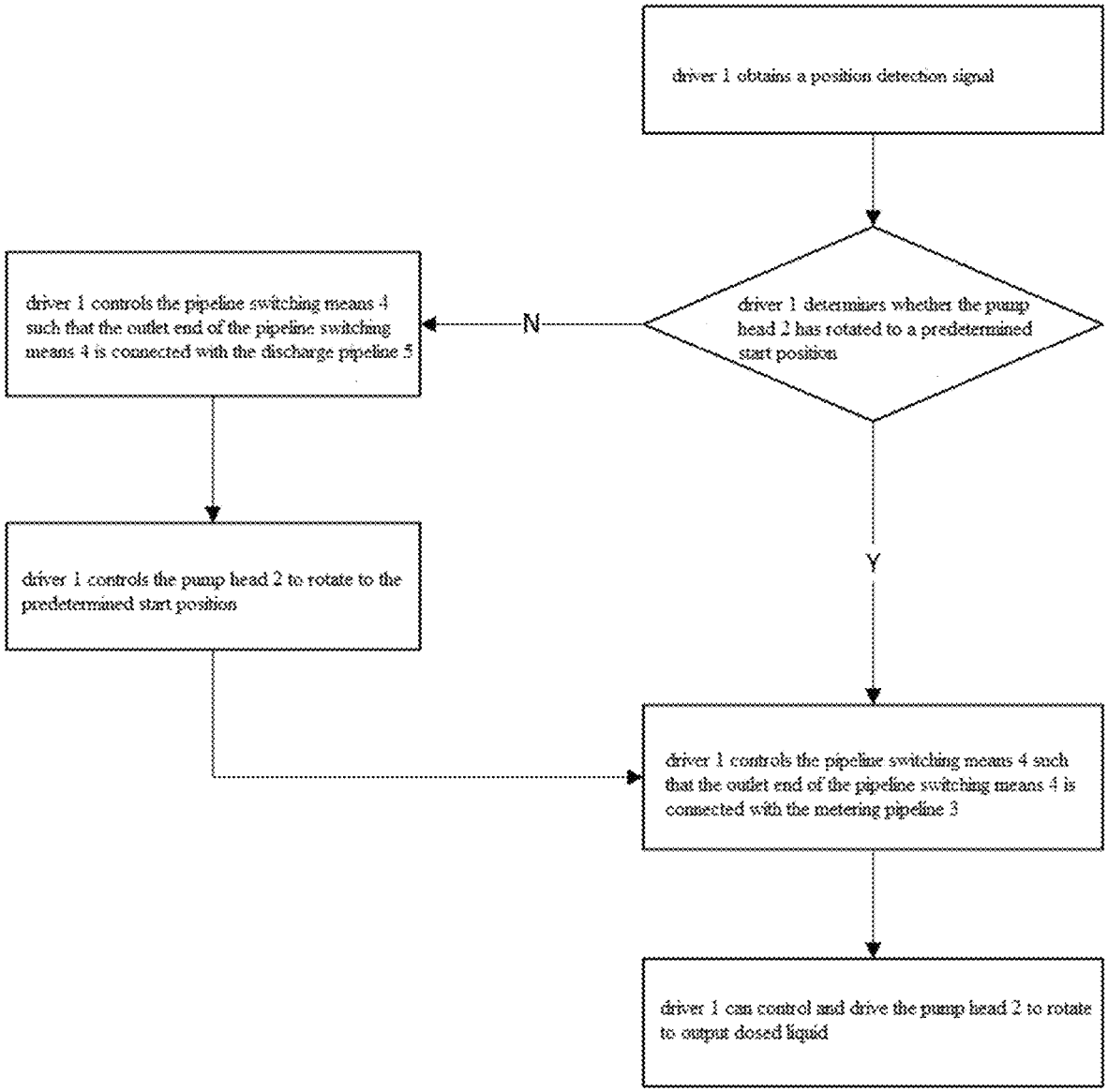
FIG. 4 is a work flow diagram of the peristaltic pump precise dosing control system according to an embodiment of the present disclosure.

When the peristaltic pump precise dosing control system according to the embodiments of the present disclosure performs dosing output of liquid, the method comprises steps below, as shown in FIG. 4:

obtaining, by the driver 1, a position detection signal to determine whether the pump head 2 has rotated to a predetermined start position. The driver 1 obtains the position detection signal from the position detecting means, wherein the position detecting means detects whether the pump head 2 has rotated to the predetermined start position. In an embodiment, the driver 1 obtains the position detection signal in response to a dosing-output start signal or a dosing-output end signal to determine whether the pump head 2 has rotated to the predetermined start position. Those skilled in the art may appreciate that the driver 1 may obtain the position detection signal at any time between one dosing output and the next dosing output to determine whether the pump head 2 has rotated to the predetermined start position.

Figure 5:
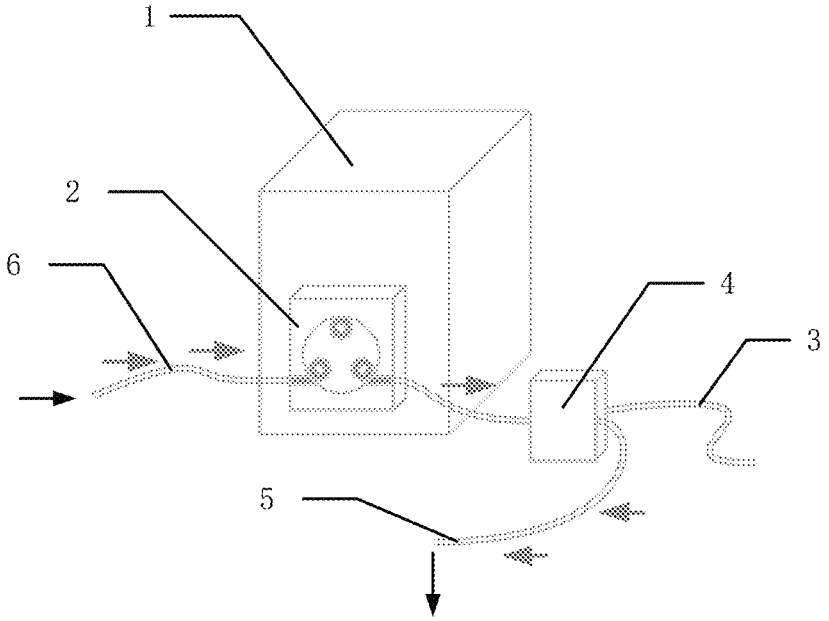
FIG. 5 is a schematic diagram of liquid flow of the peristaltic pump precise dosing control system when performing discharge according to an embodiment of the present disclosure.

In response to the position detection signal that the pump head 2 has not rotated to the predetermined start position, the driver 1 controls the pipeline switching means 4 such that the outlet end of the elastic tubing is connected to the discharge pipeline 5, and at this point, the outlet end of the elastic tubing does not be connected to the metering pipeline 3, as shown in FIG. 5; and the driver 1 controls the pump head 2 to continue rotating toward the predetermined start position. During this process, the liquid outputted from the elastic tubing in the pump head 2 is discharged via the discharge pipeline 5.

Figure 6:
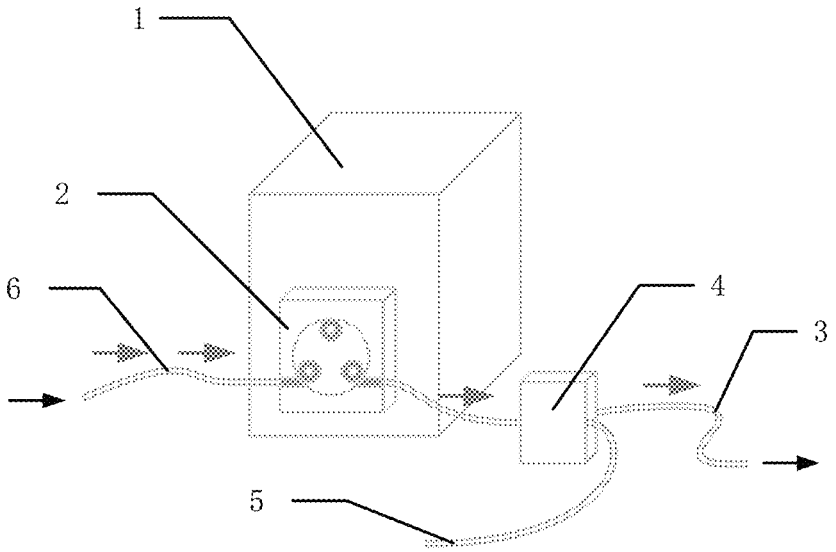
FIG. 6 is a schematic diagram of liquid flow of the peristaltic pump precise dosing control system when performing dosing output according to an embodiment of the present disclosure.

After the pump head 2 has rotated to the predetermined start position, the driver 1 controls the pipeline switching means 4 such that the outlet end of the elastic tubing is connected to the metering pipeline 3, and at this point, the outlet end of the elastic tubing does not be connected to the discharge pipeline 5, as shown in FIG. 6. As such, the driver 1 is adaptable to control and drive the pump head 2 to rotate to output dosed liquid.

The above process repeats at each time when the peristaltic pump outputs the dosed liquid.

Based on the above illustrations, those skilled in the art would appreciate that the peristaltic pump as illustrated in the embodiments includes, but is not limited to, a rotary peristaltic pump, a key type peristaltic pump, and a linear peristaltic pump.

Therefore, the peristaltic pump precise dosing control system according to the embodiments of the present disclosure is further provided with pipeline switching means and a discharge pipeline over conventional peristaltic pumps, wherein by determining the rotated position of the pump head and by starting the pipeline switching means at appropriate time to switch to a connected pipeline, it is realized that liquid is discharged during adjustment of the pump head; furthermore, the present disclosure realizes a complete identical pump head start position for each dosing output of liquid, thereby eliminating dosing transfer errors incurred by pulsation and offering a high repetitive precision.

Figure 7:
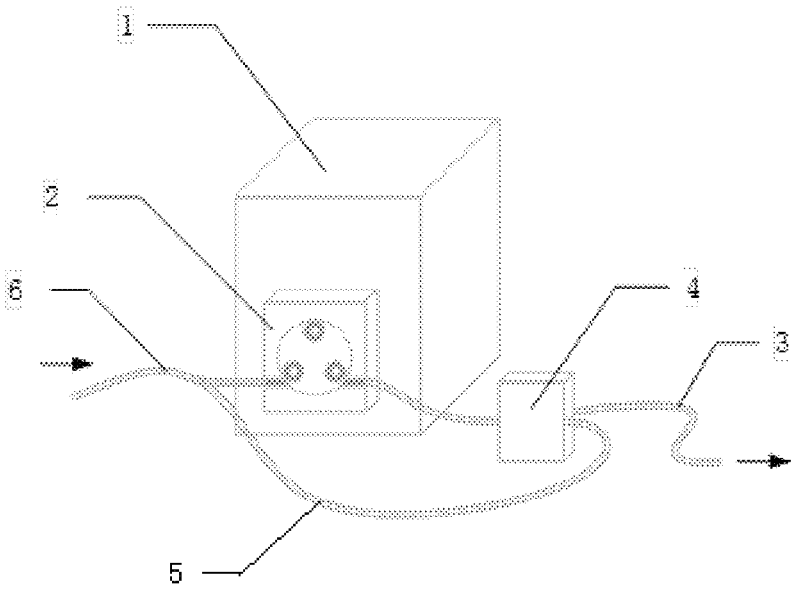
FIG. 7 is a structural schematic diagram of a peristaltic pump precise dosing control system according to another embodiment of the present disclosure.
Figure 8:
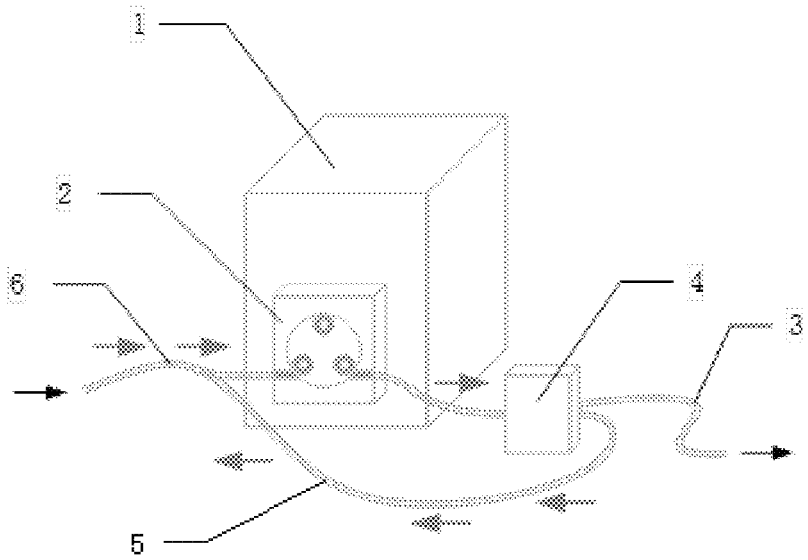
FIG. 8 is a schematic diagram of liquid flow of the peristaltic pump precise dosing control system when performing discharge according to another embodiment of the present disclosure.

Another embodiment of the present disclosure provides a peristaltic pump precise dosing control system, as shown in FIGS. 7 and 8. The difference from the preceding embodiment lies in that the discharge pipeline 5 is connected to the input line 6, such that a backflow passage from the outlet end of the elastic tubing to the input line 6 is formed to enable the liquid discharged by the peristaltic pump to flow back to the input line 6, which enhances liquid utilization and also prevents contamination to the liquid discharged via the discharge pipeline.

Figure 9:
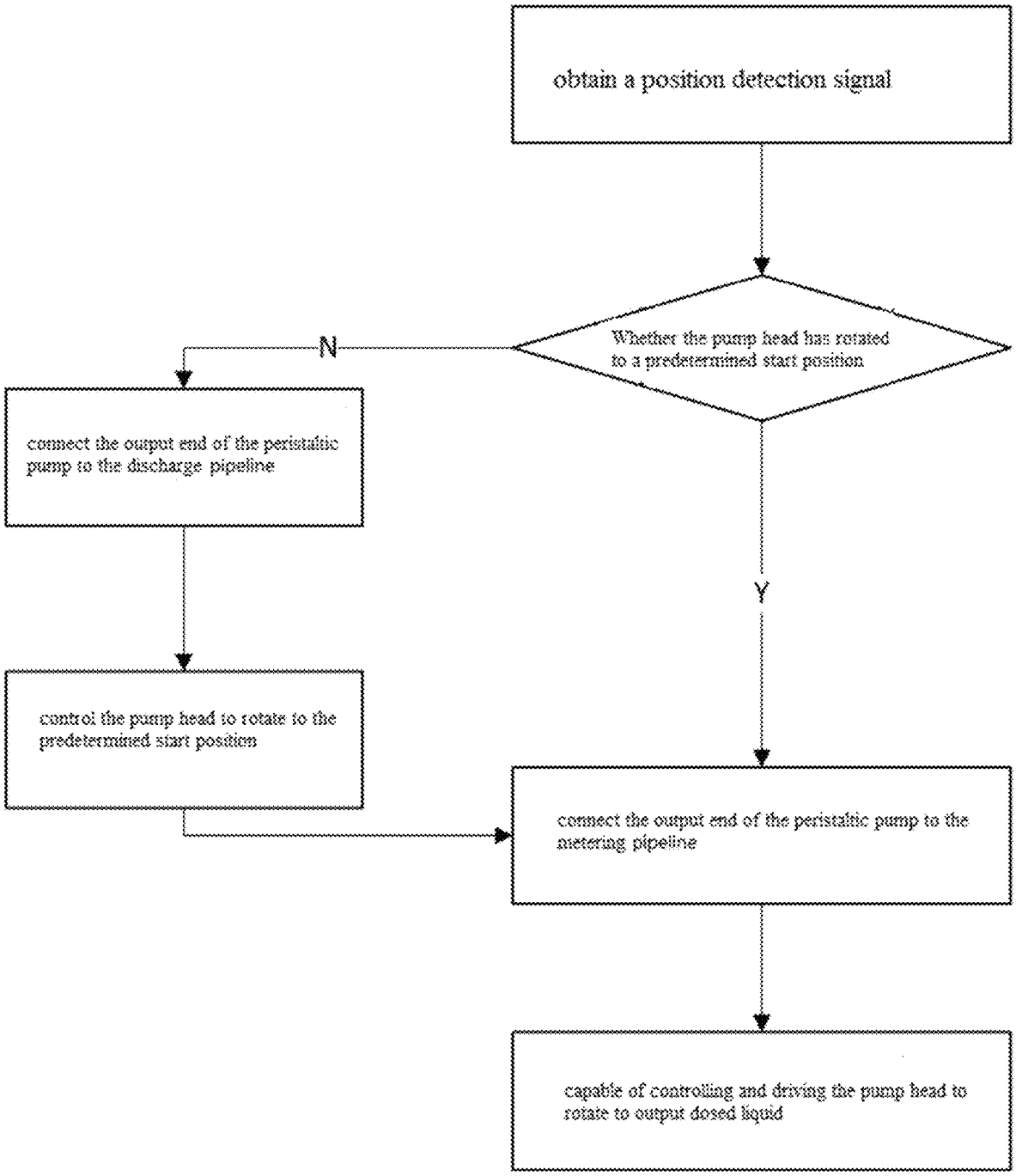
FIG. 9 is a work flow diagram of a peristaltic pump precise dosing control method according to an embodiment of the present disclosure.

Embodiments of the present disclosure further provide a peristaltic pump precise dosing control method, which, when performing dosing output of liquid, as shown in FIG. 9, comprises steps of:

obtaining a position detection signal to determine whether the pump head has rotated to a predetermined start position; in an embodiment, in response to a dosing-output start signal or a dosing-output end signal, obtaining a position detection signal to determine whether the pump head has rotated to the predetermined start position. Those skilled in the art would appreciate that the position detection signal may be obtained at any time between one dosing output and the next dosing output to determine whether the pump head has rotated to the predetermined start position;

in response to the position detection signal that the pump head has not rotated to a predetermined start position, connecting the outlet end of the peristaltic pump elastic tubing to the discharge pipeline, and controlling the pump head to rotate to the predetermined start position, wherein during this process, the liquid outputted from the elastic tubing in the pump head 2 is discharged from the discharge pipeline 5;

in response to the position detection signal that the pump head is at the predetermined start position, connecting the outlet end of the peristaltic pump elastic tubing to the metering pipeline, so as to be capable of controlling and driving the pump head 2 to rotate to output dosed liquid.

In an embodiment, the liquid discharged via the discharge pipeline returns to the input of the peristaltic pump.

The peristaltic pump precise dosing control method according to the embodiments of the present disclosure enables prompt adjustment of the connection path for the outlet end of the peristaltic pump elastic tubing by determining the rotated position of the pump head, which realizes liquid discharge during adjustment of the pump head; furthermore, the present disclosure realizes a complete identical pump head start position for each dosing output of liquid, thereby eliminating dosing transfer errors incurred by pulsation and offering a high repetitive precision.

Embodiments of the present disclosure further provide a storage medium that stores a computer program for executing the method.

Embodiments of the present disclosure further provide a processor that executes a computer program according to the method.

To test the technical effects of the peristaltic pump precise dosing control system and the control method thereof according to the embodiments of the present disclosure, the inventors have made the following testing:

1. Testing instruments: a conventional peristaltic pump; a present peristaltic pump, a YZ15 pump head (applicable to 13 #, 14 #, and 17 #tubing, flow rate ranging from 3 to 990 mL/min), YT25 pump head (applicable to 15 #, 24 #, and 35 #tubing, flow rate ranging from 50 to 1600 mL/min), YZ25 pump head (applicable to 15 #, 24 #tubing, flow rate ranging from 50 to 990 mL/min), a high precision electronic scale (precision 0.0001 g), 13 #silicone tubing (wall thickness 1.7 mm, inner diameter 0.8 mm), 14 #silicone tubing (wall thickness 1.7 mm, inner diameter 1.6 mm), 15 #silicone tubing (wall thickness 2.4 mm, inner diameter 4.8 mm), 17 #silicone tubing (wall thickness 1.6 mm, inner diameter 6.4 mm), 24 #silicone tubing (wall thickness 2.4 mm, inner diameter 6.4 mm), 35 #silicone tubing (wall thickness 2.4 mm, inner diameter 7.9 mm), 19 #silicone tubing (wall thickness 1.6 mm, inner diameter 2.4 mm), a solenoid valve;

2. Testing conditions: room temperature, atmospheric pressure, with water as transfer medium, and the lengths of the peristaltic input line and the output pipeline are both 0.5 m;

3. Computing Method: conducting four sets of experiments under each laboratory condition to obtain filling data (wherein the data resulting from control examples are measured at the outlet end of the peristaltic pump elastic tubing, and the data resulting from the present embodiments are measured at the outlet end of the metering pipeline), and recording the motor speeds, filling time, absolute errors, and error rates, where:

Absolute error=maximum value−minimum value;

Error rate=absolute error/mean value.

Table of Testing Data

| Experiment No. | $M_1$ (g) | $M_2$ (g) | $M_3$ (g) | $M_4$ (g) | $M_5$ (g) |
|---|---|---|---|---|---|
| Embodiment 1: precision testing data, using the present peristaltic pump, YZ25 pump head, and 15# silicone tubing to fill 0.5 ml | | | | | |
| 1 | 0.5000 | 0.5008 | 0.4968 | 0.4955 | 0.4993 |
| 2 | 0.4984 | 0.4977 | 0.4995 | 0.4971 | 0.4987 |
| 3 | 0.4941 | 0.5001 | 0.4951 | 0.4966 | 0.4982 |
| 4 | 0.4992 | 0.4997 | 0.4991 | 0.4991 | 0.4965 |
| Absolute Error (g) | | | 0.0067 | | |
| Error Rate (%) | | | 1.35% | | |
| Speed (rpm) | 113.5 | | Filling Time (s) | 0.2 | |
| Control Example 1: precision testing data, using the conventional peristaltic pump, YZ25 pump head, and 15# silicone tubing to fill 0.5 ml | | | | | |
| 1 | 0.5107 | 0.5041 | 0.5132 | 0.5029 | 0.5647 |
| 2 | 0.6189 | 0.5751 | 0.5266 | 0.5014 | 0.5006 |

-continued

Table of Testing Data

| | | | | | |
|---|---|---|---|---|---|
| 3 | 0.5081 | 0.5117 | 0.5292 | 0.5982 | 0.6037 |
| 4 | 0.5516 | 0.5018 | 0.5028 | 0.5045 | 0.5117 |
| Absolute Error (g) | | | 0.1183 | | |
| Error Rate (%) | | | 22.23% | | |
| Speed (rpm) | 113.5 | | Filling Time (s) | 0.2 | |
| Embodiment 2: precision testing data, using the present peristaltic pump, YT25 pump head, and 35# silicone tubing to fill 5 ml | | | | | |
| 1 | 5.0098 | 4.9909 | 4.9730 | 4.9909 | 5.0123 |
| 2 | 5.0040 | 5.0272 | 5.0007 | 4.9960 | 5.0324 |
| 3 | 5.0151 | 4.9885 | 5.0267 | 4.9767 | 5.0167 |
| 4 | 5.0130 | 4.9917 | 5.0064 | 4.9879 | 4.9990 |
| Absolute Error (g) | | | 0.0594 | | |
| Error Rate (%) | | | 1.19% | | |
| Speed (rpm) | 115.2 | | Filling Time (s) | 0.8 | |
| Control Example 2: precision testing data, using the conventional peristaltic pump, YT25 pump head, and 35# silicone tubing to fill 5 ml | | | | | |
| 1 | 4.7386 | 5.1996 | 5.0849 | 4.6742 | 5.0431 |
| 2 | 4.8439 | 4.9199 | 5.3623 | 4.6173 | 4.8491 |
| 3 | 5.2960 | 4.7603 | 4.9880 | 5.2139 | 4.8448 |
| 4 | 5.0536 | 5.2251 | 4.6920 | 5.0604 | 5.1939 |
| Absolute Error (g) | | | 0.7450 | | |
| Error Rate (%) | | | 14.95% | | |
| Speed (rpm) | 115.2 | | Filling Time (s) | 0.8 | |
| Embodiment 3: precision testing data, using the present peristaltic pump, YZ15 pump head, and 17# silicone tubing to fill 5 ml | | | | | |
| 1 | 5.0043 | 5.0141 | 5.0126 | 5.0157 | 5.0149 |
| 2 | 5.0194 | 5.0139 | 5.0187 | 5.0047 | 5.0188 |
| 3 | 5.0160 | 5.0105 | 5.0147 | 5.0141 | 5.0131 |
| 4 | 5.0092 | 5.0083 | 5.0034 | 5.0115 | 5.0003 |
| Absolute Error (g) | | | 0.0191 | | |
| Error Rate (%) | | | 0.38% | | |
| Speed (rpm) | 600.0 | | Filling Time (s) | 0.2 | |
| Control Example 3: precision testing data, using the conventional peristaltic pump, YZ15 pump head, and 19# silicone tubing to fill 5 ml | | | | | |
| 1 | 5.0285 | 5.0196 | 5.0127 | 5.0257 | 5.0025 |
| 2 | 5.0007 | 5.0055 | 5.0118 | 5.0127 | 5.0160 |
| 3 | 5.0144 | 5.0149 | 5.0130 | 5.0114 | 5.0132 |
| 4 | 5.0296 | 5.0272 | 5.0218 | 5.0147 | 5.0124 |
| Absolute Error (g) | | | 0.0289 | | |
| Error Rate (%) | | | 0.58% | | |
| Speed (rpm) | 600 | | Filling Time (s) | 0.99 | |

Data Summarization and Comparison

| Installation Manner | Pump head + tubing | Motor speed/Filling Time (s) | Filling amount | Absolute Error (g) | Error Rate (%) |
|---|---|---|---|---|---|
| Example 1 | YZ25 + 15# | 113.5 rpm/0.2 s | 0.5 ml | 0.0067 ml | 1.35% |
| Control Example 1 | Silicone tubing | 113.5 rpm/0.2 s | 0.5 ml | 0.118 ml | 22.23% |
| Example 2 | YT25 + 35# | 115.2 rpm/0.84 s | 5 ml | 0.059 ml | 1.19% |
| Control Example 2 | Silicone tubing | 115.2 rpm/0.84 s | 5 ml | 0.75 ml | 14.95% |
| Example 3 | YZ15 + 17# Silicone tubing | 600 rpm/0.17 s | 5 ml | 0.019 ml | 0.38% |
| Control Example 3 | YZ15 + 19# Silicone tubing | 600 rpm/0.99 s | 5 ml | 0.029 ml | 0.58% |

Conclusion

Under the same conditions, the peristaltic pump precise dosing control system according to the present disclosure may enhance the dosing transfer precision by at least tenfold above;
or shorten the filling time by at least 5 times; or enhance the productivity by fivefold above; and correspondingly the service life of the tubing is extended.

Those skilled in the art would appreciate that the logic and/or steps illustrated in the flow diagrams or described herein in other manners, for example, may be understood as a sequencing list of executable instructions for implementing the logic functions, or may be embodied on any computer-readable medium, available for an instruction executing system, apparatus or device (e.g., a computer-based system, a system including a processor, or any other system that may retrieve and the execute the instruction from the instruction executing system, apparatus or device), or used in conjunction with such instruction executing systems, apparatuses, or devices. In the present disclosure, the "computer-readable medium" may refer to any device that may embody, store, communicate, propagate or transfer programs for the instruction executing system, apparatus or device to use or for use in conjunction with such instruction executing systems, apparatuses or devices.

More specific examples (a non-exhaustive list) of the computer-readable storage medium may include an electrical connection having one or more wires (electronic devices), a portable magnetic disk (magnetic device), a read-only memory (ROM), an erasable programmable read-only memory (EPROM or flash memory), an optical fiber device, and a portable compact disk read-only memory (CD-ROM). Additionally, the computer-readable medium may even be paper or any other appropriate medium on which the program may be printed, because the program may be obtained electronically by for example performing optical scanning to paper or other medium, and then performing editing, interpreting, or processing in other manners when necessary, and then is stored in the computer memory.

It is understood that various embodiments of the present disclosure may be implemented by hardware, software, firmware or a combination thereof. In the embodiments above, a plurality steps or methods may be stored in the memory or implemented by software or firmware executed by an appropriate instruction executing system. For example, if they are implemented by hardware, they may be implemented by any one or a combination of the following known arts in the field, like in the another embodiment: a discreet logic circuit having a logic gate circuit for implementing a logic function to the data signals, a specific integrated circuit having an appropriate combined logic gate circuit, a programmable gate array (PGA), and a field programmable gate array (FPGA), etc.

In the depictions of the specification, terms such as "an embodiment," "some embodiments," "an example," "specific examples," o "some examples" mean that specific features, structures, materials or characteristics described in conjunction with the embodiment or example are included in at least one embodiment of example of the present disclosure. In the specification, schematic expressions of the above terms do not necessarily refer to the same embodiments or examples. Moreover, the specific features, structures, materials or characteristics as described may be combined in any appropriate way in any one or more embodiments or examples.

Embodiments of the present disclosure have been described above. However, the present disclosure is not limited to the embodiments above. Any modifications, equivalent substitutions, and improvements within the spirit and principle of the present disclosure should be included within the protection scope of the present disclosure.

We claim:

1. A peristaltic pump precise dosing control system, comprising: a driver, a pump head, a pipeline switching means, a position detecting means, a metering pipeline, and a discharge pipeline, wherein:

the pump head is provided with an elastic tubing, an outlet end of the elastic tubing being connected to the pipeline switching means;

the pipeline switching means is adaptable to switch the outlet end of the elastic tubing to be connected to the metering pipeline or the discharge pipeline;

the driver is configured to drive the pump head to rotate to pump the liquid in the elastic tubing to the outlet end of the elastic tubing, and the driver is electrically connected to the pipeline switching means so as to control the pipeline switching means;

the position detecting means is electrically connected to the driver and configured to detecting a position of the pump head, wherein, during operation, in response to a dosing-output start signal or a dosing-output end signal, the position detecting means determines whether the pump head is at a predetermined start position and sends a corresponding position detection signal to the driver, when the pump head is at the predetermined start position, the driver causes the pipeline switching means to switch the outlet end of the elastic tubing from a state of connection with the discharge pipeline to a state of connection with the metering pipeline.

2. The peristaltic pump precise dosing control system according to claim 1, further comprises an input line connected to the inlet end of the elastic tubing in the pump head.

3. The peristaltic pump precise dosing control system according to claim 2, wherein the discharge pipeline is connected to the input line to form a backflow passage from the outlet end of the elastic tubing to the input line.

4. The peristaltic pump precise dosing control system according to claim 1, wherein the driver comprises a control panel and an electric motor, the control panel being connected to the electric motor, the position detecting means, and the pipeline switching means; and the position detecting means is provided on the electric motor, or the pump head, or a connector between the electric motor and the pump head.

5. The peristaltic pump precise dosing control system according to claim 1, wherein a roller wheel of the pump head has at least one roller, and the position detecting means is adaptable to detect whether the at least one roller has revolved to the predetermined start position; or, the position detecting means comprises a magnetic inductor and a magnetic steel, wherein the magnetic inductor, which is electrically connected to the driver and disposed at a rear shaft that drives the pump head to rotate, is adaptable to detect a rotation of the magnetic steel.

6. A control method of the peristaltic pump precise dosing control system according to claim 1, comprising steps of:

in response to a dosing-output start signal or a dosing-output end signal, determining, by the position detecting means, whether the pump head is at the predetermined start position and sending the corresponding position detecting signal to the driver;

obtaining, at the driver, the position detection signal, when the position detection signal indicates that the pump head has not rotated to the predetermined start position, controlling, by the driver, the pipeline switching means such that the outlet end of the elastic tubing is connected to the discharge pipeline, wherein the driver controls the pump head to rotate toward the predetermined start position; or when the position detection signal indicates that the pump head is at the predetermined start position, controlling, by the driver, the pipeline switching means such that the outlet end of the elastic tubing is connected to a metering pipeline so that the driver drive the pump head to output dosed liquid.

7. The method of claim 6, wherein, when performing dosing output of fluid, in response to the position detection signal that the pump head is not at the predetermined start position, connecting the outlet end of the elastic tubing to a discharge pipeline, and controlling the pump head to continue rotating toward the predetermined start position; and in response to the position detection signal that the pump head is at the predetermined start position, connecting the outlet end of the peristaltic pump elastic tubing to a metering pipeline so as to be capable of controlling and driving the pump head to rotate to output dosed liquid.

8. The method according to claim 7, further comprising returning a liquid discharged via the discharge pipeline to the input of the peristaltic pump.

* * * * *